US008893751B2

(12) United States Patent
Kuhnert et al.

(10) Patent No.: US 8,893,751 B2
(45) Date of Patent: Nov. 25, 2014

(54) DEVICE FOR PRODUCING A LOOP ON ONE END OF A COIL SPRING

(75) Inventors: Oliver Kuhnert, Reutlingen (DE); Andreas Schur, Erms (DE)

(73) Assignee: Wafios Aktiengesellschaft, Reutlingen (DE)

( * ) Notice: Subject to any disclaimer, the term of this patent is extended or adjusted under 35 U.S.C. 154(b) by 784 days.

(21) Appl. No.: 12/903,005

(22) Filed: Oct. 12, 2010

(65) Prior Publication Data

US 2011/0247717 A1 Oct. 13, 2011

(30) Foreign Application Priority Data

Apr. 9, 2010 (DE) ..... 10 2010 014 353

(51) Int. Cl.
*B21F 35/00* (2006.01)
*B21F 3/00* (2006.01)
*B21F 35/02* (2006.01)

(52) U.S. Cl.
CPC ..... *B21F 35/02* (2013.01)
USPC ..... 140/103; 140/102; 72/137

(58) Field of Classification Search
CPC ..... B21F 3/00; B21F 3/02; B21F 3/027
USPC ..... 72/135–138, 145, 371; 140/71 C, 102, 140/103
See application file for complete search history.

(56) References Cited

U.S. PATENT DOCUMENTS 3,192,748 A 7/1965 Lange
3,230,985 A * 1/1966 Kaufmann ..... 140/103
3,245,433 A * 4/1966 Taylor, Jr. ..... 140/71 R
3,313,325 A * 4/1967 Wells ..... 140/103
3,662,788 A * 5/1972 Clarke et al. ..... 140/103
3,678,970 A * 7/1972 Dammel ..... 140/103
3,782,425 A * 1/1974 Clarke et al. ..... 140/103
3,915,204 A * 10/1975 Kaufman et al. ..... 140/103
4,485,851 A 12/1984 Takumi
4,542,635 A * 9/1985 Matsuoka ..... 72/18.5
4,680,950 A * 7/1987 Ohdai et al. ..... 72/130
5,657,657 A * 8/1997 Welsh et al. ..... 72/139
5,706,687 A * 1/1998 Welsh et al. ..... 72/138
6,393,888 B1 * 5/2002 Sautter et al. ..... 72/140
7,334,445 B2 * 2/2008 Speck ..... 72/137

FOREIGN PATENT DOCUMENTS

EP 0 117 097 8/1984
GB 1 294 495 A 10/1972

* cited by examiner

*Primary Examiner* — Shelley Self
*Assistant Examiner* — Lawrence Averick
(74) *Attorney, Agent, or Firm* — Christensen Fonder P.A.

(57) ABSTRACT

A device for producing a loop at the end of a coil spring has a gripping unit with gripper jaws for retaining the spring in a processing position. The gripping unit is movable to and from the processing position and at least one section of an end turn of the spring protrudes over the gripper jaws. A first slewing gear unit has an output shaft and a coupling section for detachable coupling of a tool for the forming of a loop on the spring through upward bending of the end turn section protruding over the gripper jaws. A counter block attached laterally to the travel direction of the gripping unit is movable over the section of the end turn of the spring protruding over the gripper jaws and has a bending edge as a bending form for producing a loop with the tool.

10 Claims, 5 Drawing Sheets

DEVICE FOR PRODUCING A LOOP ON ONE END OF A COIL SPRING

This application claims priority to German Patent Application No. 10 2010 014 353.7 filed on Apr. 9, 2010, which is incorporated herein by reference in its entirety.

FIELD OF THE INVENTION

The invention relates to a device for producing a loop at the end of a coil spring, with a gripping unit with gripper jaws for retaining the spring in a processing application.

BACKGROUND OF THE INVENTION

Devices for producing a loop at the end of a coil spring are, as a rule, positioned before a leg spring machine, wherein the spring is prefabricated, i.e., wound or bent, whereby the prefabricated spring, before the cutting of the wire, is gripped by the grippers of a gripping unit of the device, is fed to a loop producing device after the cutting and the second loop produced at the end of the spring. The first loop at the beginning of the spring is already produced in the spring machine. However, in principle, such devices for affixing of a loop can be coupled with any kind of spring machine.

From DE 1 402 878 C, a device is known, whereby in several stations loops are produced on both ends of a spring. However, this known device is very elaborate and requires significant floor space. The individual devices contained therein are driven by a continuous pull of drive shafts arranged rectangularly to each other and coupled by means of bevel gear pairs, one of which is driven by an assigned spring winding machine. The great number of applied mechanical parts in connection with the complicated kinematics and the continuous mechanical control of all elements requires that relatively great power be applied for the operation of said device simply to overcome the notable friction, whereby efficiency as well as processing speed of said device are markedly limited.

In U.S. Pat. No. 3,782,425 A, a device for producing a loop at the end of a coil spring is described, whereby the coil spring is held in a processing position by a gripping unit with gripper jaws. Thereby, an upper end turn of the spring protrudes over the gripper jaws, which is gripped from underneath by a first tool with a beveled front edge approaching laterally and which is tilted upward to a certain height through a further approach of said tool. Subsequently, the tool is retracted and the end turn is moved still further in its exposed end position by means of a second tool approaching from the same side, whereby the upended spring turn is pressed against a third tool approaching from the opposite direction, acting as a type of stop. This known device operates in a relatively complicated manner and with a great number of individual steps, and allows for the execution of only one type of upward bending of the uppermost end turn of the spring.

Furthermore, another device is known (EP 0 117 097 B1) with which on coil springs that exhibit on their end a protruding tongue and the end of which exhibits a bent hook, the tongue, positioned tangentially to the end turn of the coil spring, is bent upward during the removal from the spring manufacturing machine in a direction parallel to the central axis of the spring. In this device, a gripping unit with gripper jaws for retaining the spring in a processing position with predetermined alignment of the central axis of the spring is provided, whereby the gripping unit can be moved to and also from the processing position. Thereby, the spring is positioned in the gripping unit in such a way that the contact tongue, positioned tangentially to the coil spring, with the already formed hook-shaped end bend protrudes sideways above the gripper jaws. For the tilting up of said tongue a tool is provided which is moved laterally in the direction of the spring and which exhibits on its upper side a beveled approach area, which approaches the protruding tongue at its free end from underneath and subsequently is tilted upward while entraining the tongue. At the same time, an additional tool is moved toward the spring from the opposite side, which exhibits a counter block with a bending edge as a bending form during the tilting up of the loop by the first tool. The approach of the second tool takes place in the processing position of the gripping unit in such a way that the counter block is moved via the uppermost end turn of the spring to a position at which the tongue is bent by the first tool. Thereby, the first tool consists of a tool bit, which is fastened to an angle lever. In order to swivel the tool bit, the angle lever grips, at its free lever end opposite of the tool bit, via a protruding roller into an assigned, inclined sliding-block track, which is designed as a rigid body. The angle lever sits on a mount, which is laterally movable, i.e., to and from the gripping unit, and the lateral movement of which is controlled via a cam gear.

Likewise, the approach and/or retraction of the second tool with the counter block is controlled, once again, by its own cam gear. Thereby, an additional third cam gear is provided, with which the spring can be removed from the processing position after the upward bending of the tongue. However, this known device is only suited for the upward tilting of a tongue of a coil spring protruding sideways over the gripper jaws but not for the forming of a loop for the upward tilting of an entire end turn or a part thereof, which does not protrude radially over the gripper jaws. In addition, due to the great number of applied cam gears, this known device is complicated with overall very complex kinematics, which in turn requires relatively great expenditure of energy for its operation, and the possible maximum processing speed is also not very high.

Therefore, it is the objective of the invention to provide a device which allows for the manufacture of half and whole German loops, English loops as well as hook loops on right-hand as well as left-hand spring bodies, whereby the loops can be pulled up from the spring body as well as bent up. In addition, the device should be designed relatively simply and allow for a high feed speed.

SUMMARY OF THE INVENTION

According to the invention, this task is achieved with the device of the aforementioned type in such a way that a first slewing gear unit is provided, the output shaft of which is drivable in opposing rotational directions and is equipped with a coupling section for detachable coupling of a tool for the forming of a loop on the spring through upward bending of the end turn section protruding over the gripper jaws. The output shaft runs essentially vertically to the central axis of the spring held in the gripping unit and is movable vertically as well as parallel to the direction of travel and parallel to the central axis of the spring. An additional counter block is provided attached laterally to the travel direction of the gripping unit with a bending edge as a bending form for producing a loop by the tool and the counter block is movable in the processing position of the gripping unit over the section of the end turn of the spring protruding over the gripper jaws.

In one embodiment a device according to the invention allows for producing a loop at the end of a coil spring in two different ways with only the mounting of an appropriate tool on the rotary shaft of the first slewing gear unit is required.

In an embodiment of a method according to the invention during which the loops are "pulled up" on the spring body, the manufacture of the loop takes place from a spring body, which was produced in a compression spring or leg spring machine, whereby the basic form of the loop does not require prior forming. Hereby, half and whole German loops, English loops as well as low hook loops can be fabricated.

In another embodiment of a method according to the invention whereby the loops are "bent," the basic form of the loop is already produced in a compression spring or leg spring machine. Then the loop is bent upward by means of a positioning plate. Hereby, half and whole German loops, English loops as well as hook loops can be produced.

The device, according to an embodiment of the invention, allows for a manufacture of loops with only one device on both paths. With the counter block, the bending radius is determined, allowing for the creation of a precisely defined bending radius between spring body and loop.

The device, according to an embodiment of the invention, in its overall concept is designed modularly in such a way that loops can also be produced with springs coiled the other way around, whereby the devices for the bending of the loop must solely be positioned in a mirrored arrangement.

Due to the adjustability, according to embodiments of the invention, of the individual units of the device their rotational axes can be respectively aligned correctly to the spring without difficulty, resulting in a high functionality of the device, whereby the exchangeability of the tool on the output shaft of the first horizontal slewing gear unit of the device contributes significantly to its high functionality.

The fact that essentially only one movable first slewing gear unit and one movable counter block must be applied for the device, according to embodiments of the invention, results overall in a relatively low constructive effort, whereby the travel and rotational motions are achievable with an electronic control as well as quickly and precisely, resulting in an overall significantly greater processing speed of the overall device. Preferably, the device can be controlled by a central control unit.

It is of particular advantage when the gripping unit is directly movable between the processing position and an intake position in both devices, according to embodiments of the invention, whereby in the latter, the gripping unit picks up the spring in a spring manufacturing machine, which ensures a particularly quick work sequence.

Preferably, the spring can be held in the gripping unit in any random alignment if the rest of the components are aligned in correspondence to the device.

It is particularly preferable, however, when the spring is held in the gripping unit in a vertical alignment of its central axis, allowing for the execution of the forming of the loop on the upper side of the spring.

A further embodiment of the invention also entails that at least one section of the end turn of the spring protrudes on the opposite side of the gripper jaws, i.e, on the bottom side of the gripping unit, and that the gripping unit is rotatable via a rotational axis, situated vertically to the central axis of the spring. This embodiment of the device even offers the option of forming a loop not only on one end of a coil spring but also on both its ends on the same device.

Furthermore, the in another embodiment of the invention a second slewing gear unit with a pivoting cantilever is provided, which supports the bending block such that the bending block is pivotable via the feed body in the processing position of the gripping installation to the stop at the free wire end of the end turn, preventing a dodging of the loop during the upward bending of the end turn of the spring. This also allows for a rebending of the already bent loop in the interest of a particularly precise alignment of said loop.

A further embodiment of the device, also provides for a bending block, pivoting around the rotational axis of the output shaft, which is attached as tool to the output shaft of the first slewing gear unit, for underneath gripping and upward bending of the forward end area of the section of the end turn of the spring protruding over the gripper jaws. The application of said tool provides the option of "pulling up" the tension spring. Thereby, the tool, before the approach of the gripping unit to the processing position, is already in a position from which the process of upward bending takes place, so that the section of the end turn protruding axially via the gripper jaws is moved onto the bending tool during the approach of the gripping unit to the processing position. Once the processing position is reached, the protruding end turn of the spring is already gripped underneath by the tool and is bent upward through the introduction of the counter block and rotating of the tool.

In order to execute the other option for producing loops, i.e., to "bend the loops upward," a positioning plate is provided as tool preferably at the output shaft of the first slewing gear unit, mounted on a radially rotating tongue attached to the output shaft parallel to the rotational axis of the output shaft, and where said positioning plate during the approach of the gripping unit to the processing position, is guided below the section of the end turn of the spring protruding over the gripper jaws, and with which the section of the end turn, resting on the position plate, is bent upward during the rotation of the slewing gear unit.

In this mode of operation, the positioning plate is also in its starting position for the subsequent rotation process when the gripping unit is led to the processing position. Thereby the rotational axis of the slewing gear unit is aligned in such a way that it lies parallel to the bending axis, i.e., the axis around which the loop is to be bent and which is predetermined by the counter block. With this type of producing loops, even longer loops, so-called "extended loops," with a precise bend can be produced. Once again, the bending block of the second slewing gear unit prevents a dodging of the coil during the bending process and allows for a rebending of the coil for a precise alignment of the loop, if necessary.

In embodiments of the device with a second slewing gear unit with a pivoting cantilever, which holds a bending block, it is advantageous when said second slewing gear unit is movable parallel to the central axis of the spring held in the gripping unit as well as vertically to the spring and the direction of travel of the gripping unit.

Furthermore, in a device, according to an embodiment of the invention, it is advantageous when the counter block is also adjustable in the direction parallel to the central axis of the spring held in the gripping unit.

Finally, a device, according to an embodiment of the invention, also provides an alignment unit, adjustable essentially vertically to the direction of travel of the gripping unit and to the central axis of the spring held therein, and parallel to the latter, with which the position of the end turn of the spring, protruding over the gripper jaws, with respect to a predetermined spring position is adjustable through the rotation of the spring in the gripper jaws of the gripping unit. In this case, the gripping unit with the retained spring on the travel path to the processing position is, preferably, at first moved to said alignment unit, where the verification of the correct alignment of the spring in the gripper jaws and, if necessary, a required correction is effected and only subsequently moved to the processing position with the spring correctly aligned in the gripping unit.

BRIEF DESCRIPTION OF THE FIGURES

In the following, the invention is further explained in principle by way of example with the help of the drawings:

FIG. 7 shows the gripping of the spring by the gripping unit;

FIG. 8 shows the approach of the gripping unit with the spring toward the tool on the output shaft of the first slewing gear unit;

FIG. 9 shows the approach of the counter block and a bending block; and

FIG. 10 shows the final position after the bending of the loop (in accordance with FIG. 4);

DETAILED DESCRIPTION

Figure 1:
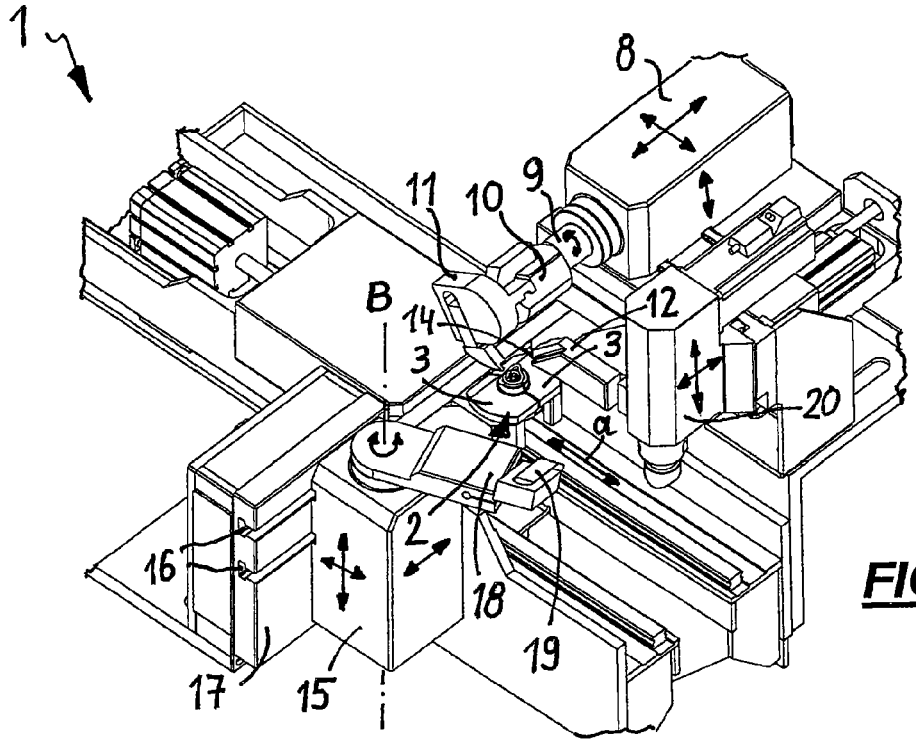
FIG. 1 shows a perspective view of a device, according to the invention, with a tool designed as bending block for the "pulling up" of the loop.
Figure 2:
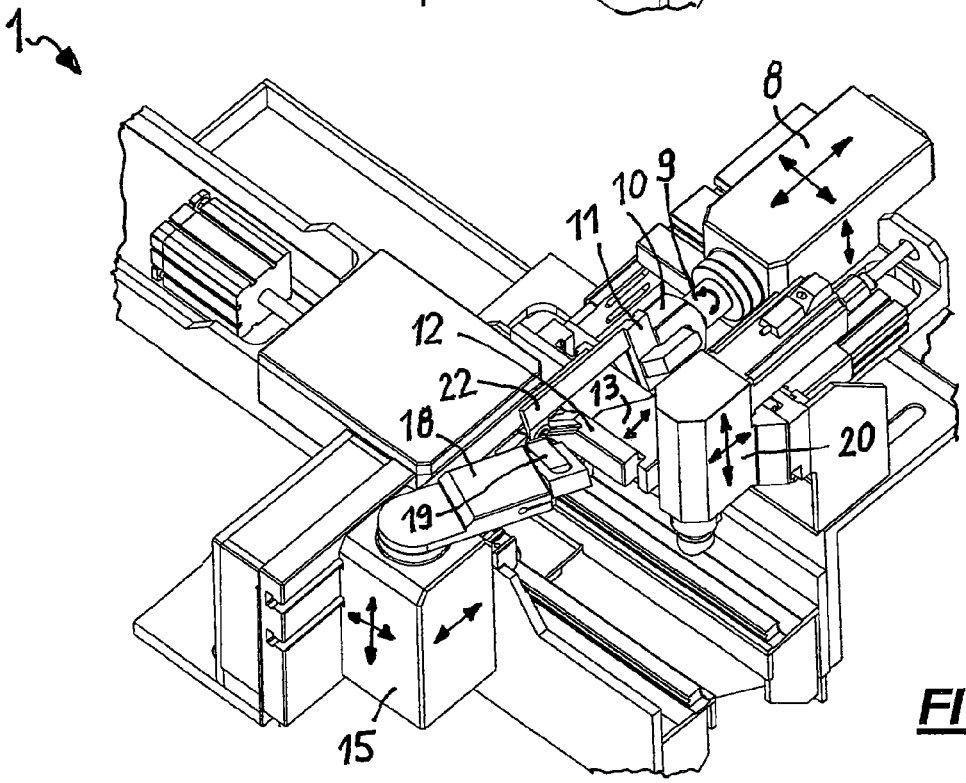
FIG. 2 shows a perspective view of a device, according to the invention, with a tool with positioning plate, with which the forming of the loop through "bending up" is effected.

FIGS. 1 and 2 show the perspective depictions of a device 1 for the loop manufacture at the end of a coil spring, whereby FIG. 1 shows a tool for "pulling up" of the loop and FIG. 2 a tool for "bending up" of the loop.

For a more detailed depiction of the design in the device 1, FIGS. 7 to 10, which show the essential parts of the device 1 in various stages of the loop manufacture in perspective assignment to each other, shall first be expanded on. Initially, the device 1 comprises a gripping unit 2, which exhibits two folding gripper jaws 3, which are designed to hold one coil spring 4 at a time. The embodiment of the gripping unit 2 with gripper jaws 3, as shown in FIGS. 7 to 14 is only a preferred embodiment of a gripping unit, which can be utilized in the device 1. Of course, another form of the gripping unit 2 with differently designed gripper jaws 3 can be applied. The gripping unit 2 with the gripper jaws 3 is movable in the longitudinal direction of the device 1 along a direction of travel a in order to, e.g., grab the springs 4, in combination with a leg spring machine 5, in said machine and subsequently move them in the device 1 to the processing position or any other desired position, as shown in FIG. 15. The processing position of the gripping unit 2 can be seen in FIG. 1 as well as FIGS. 8 to 10, and 12 to 14. In FIG. 2, the gripping unit 2 has also reached the processing position but is not visible due to the perspective covering by other elements.

Figure 8:
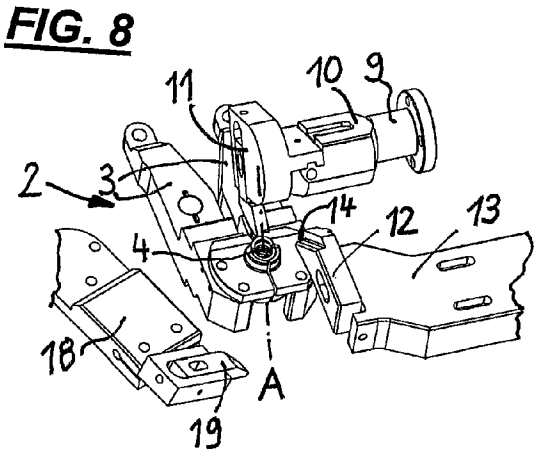
FIGS. 7, 8, 9, and 10 show as perspective depiction the process for manufacturing of a loop in a device, according to the invention, whereby the loop is "pulled up," in various stages of the manufacturing process, whereby
Figure 10:
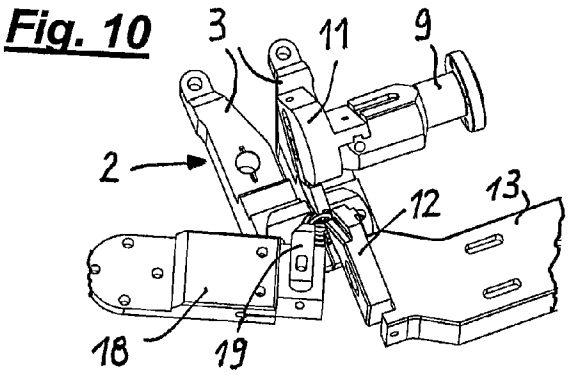

The coil spring 4 held by the gripper jaws 3 is exactly aligned with its central axis A (see FIG. 8). In this alignment it will subsequently be processed with other tools in the processing position. As can be best seen in the basic side views of FIGS. 3 to 6, the coil spring 4 protrudes in the direction of its axial extent over the gripper jaws 3 (in the Fig. depictions: upward) at least by a sufficiently large enough section of an end turn, which allows for a certain travel underneath and therefore gripping by the bending tool for upward bending. The remaining part of the spring body 7 is held tightly within the gripper jaws 3 of the gripping unit 2.

Furthermore, the device 1 comprises a first slewing gear unit 8 with an output shaft 9 which is drivable in both rotational directions (see FIG. 1). On the drive shaft 9, a coupling section 10 is attached, onto which a lathe tool 11 can be coupled (interchangeably). In the embodiment of the coupling section 10 as shown in the drawings, said section is constructively designed in such a way that the tools can be coupled and removed by means of a quick-action coupling. Thereby, the output shaft 9 is aligned in such a way that it runs lateral, particularly essentially vertical, to the central axis A of the coil spring 4 held in the gripping unit 2. Hereby (as in the following realizations), "essentially vertical" shall indicate that an alignment of the output shaft 9 in vertical direction to the axis A is preferred but that certain deviations from such an alignment are possible, which in special cases can be helpful. In all cases, an alignment lateral to the central axis A of the coil spring 4 must be maintained. In addition, the slewing gear unit 8 is also movable with regard to its height (parallel to the central axis A of the coil spring 4) as well as vertically and parallel to the direction of travel a.

Moreover, the device 1 comprises a counter block 12, which is attached to the protruding end of a slider 13 and attached laterally to the direction of travel a of the gripping unit 2. By means of the slider 13, the counter block 12, which exhibits at its protruding end a bending edge 14 as bending form for the manufacture of the loop through the tool 11, can be moved to and from the processing position of the gripping unit 2. In addition, the slider 13 is movable laterally to the central axis A and the direction of travel a of the gripping unit 2, whereby preferably an essentially vertical movability in transverse direction is provided.

Furthermore, the device 1 can provide for a second slewing gear unit 15, the rotational axis B of which is directed essentially vertically upward (preferred vertically to the travel axis a) and which is adjustable, preferably movable, via lateral slot guides 16 in a vertical steering plate 17 in transverse direction, particularly vertically, to the travel axis a. In addition, the second slewing gear unit 15 is also movable, as shown in FIGS. 1 and 2 only in principle, in the latitudinal direction as well as parallel to the travel axis a. At its upper end, the second slewing gear unit 15 holds a pivoting cantilever 18, which exhibits at its freely protruding end a bending block 19. Through swiveling of the cantilever 18 towards the coil spring 4 in its processing position, the bending block 19 can be positioned against the free end of the axially protruding section of the coil spring 4 on the side opposite to the processing side of the tool 11, so that this end of the coil spring 4 can prop up against the bending block 19 during the bending process and thereby prevent a dodging of the coil 6 during the upward bending.

Finally, the device 1 can also provide for an alignment unit 20 which is adjustable in the direction of the travel axis a to and from the gripping unit 2 as well as in the latitudinal direction. The alignment unit 20 ensures a correct positioning of the coil spring 4 in the gripper jaws 3 for the subsequent processing, whereby said alignment unit, arranged above the spring 4, detects the spring's actual position and, in case of deviations from the desired position, turns the spring, e.g., through gripping at the upper spring end within the gripper jaws 3 in such a way that the spring eventually assumes the desired rotational alignment.

Now FIGS. 3 to 6 are herewith referenced in order to illustrate the mode of operation of the tools 11 for the two different methods of production for "pulling up" and "bending up" of the loop.

Figure 3:
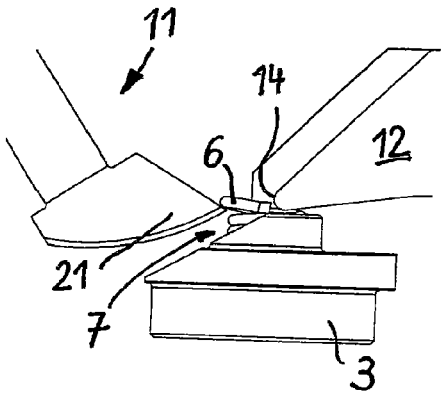
FIG. 3 shows a very basic depiction of the loop production process, whereby the loop is pulled up after the approach of the gripping unit to the processing position and the approach of the counter block, prior to the beginning of the "pull up;"
Figure 11:
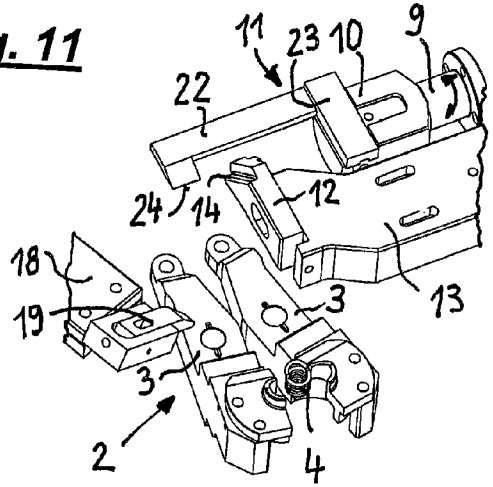

In FIG. 11, the tool is designed in such a way that the loop can be pulled up. FIG. 3 shows the condition whereby the spring body 7 with its uppermost coil 6, which protrudes on the upper side over the gripper jaws 3, is moved to the processing position.

Figure 4:
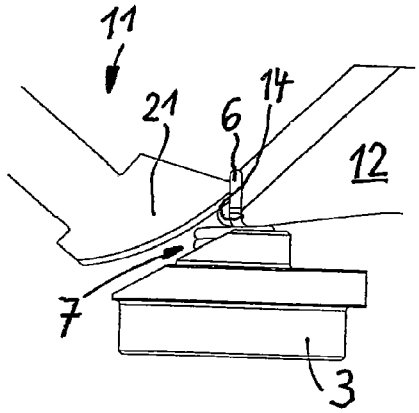
FIG. 4 shows a basic side view as in FIG. 3 but after the completion of the pulling up of the loop.

The tool 11 exhibits a bending block 21, which is attached below to the tool 11, whereby the rotational axis of the first slewing gear unit 8 is positioned before the spring 4 (in travel direction of the spring 4 toward the processing position). Thereby, the leading edge of the bending block 21 grips the last coil 6 of the spring 4 from underneath while the first slewing gear unit 8 is turned counterclockwise and bends said coil with a further rotary movement at the bending edge 14 of the counter block 12 positioned above the spring body 7. With this tool 11, loops can be "pulled up" from "normal" coils (i.e., the end turn 6 has the same diameter as the spring body 7). FIG. 4 shows the end position after the end turn 6 was positioned around the bending edge 14 by the bending block 21 in an alignment roughly parallel to the central axis A.

Figure 5:
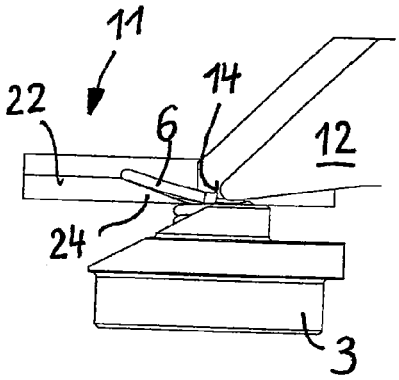
FIG. 5 shows a basic side view of the loop production process, whereby the loop if formed through "bending up" after the approach of the gripping unit to the processing position and the approach of the counter block, prior to the bending process.
Figure 6:
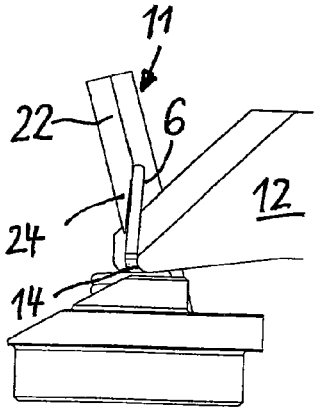
FIG. 6 shows a basic side view in accordance with FIG. 5 but after completion of the bending up process of the loop.

FIGS. 5 and 6 show the other mode of production, whereby the loop is "bent up:" Hereby, the tool 11 comprises a positioning plate 22, as is particularly apparent from the depictions in FIGS. 11 to 14. As shown in these drawings, the positioning plate 22 is attached radially outside to a radial tongue 23 of the tool 11 and is aligned in its initial position, as shown in FIGS. 5 and 11, in such a way that its end edge 24, which is attached at the end of a wedge-shape profiled section of the positioning plate 22, which in turn serves for underneath gripping of the uppermost spring coil 6, lies essentially vertical to the central axis A of the coil spring 4 held in the gripper jaws 3. In this case, the edge 24 must be aligned in such a way that it is positioned parallel to the bending edge 14 at the front end of the counter block 12. When the gripping unit 2 with the coil spring 4 approaches the processing position, the positioning plate 22 is already present in its initial position. Thereby, during the approach toward the processing position, the positioning plate 22 is inserted between the upper coil 6 and the following coil of the spring body 7. During the subsequent rotating of the first slewing gear unit 8, the coil 6 resting on the position plate 22 is bent up as shown in FIG. 2 as well as FIG. 6 and in the sequence of FIGS. 11 to 14. This way, even longer loops (extended loops) with a precise bend can be manufactured.

Figure 7:
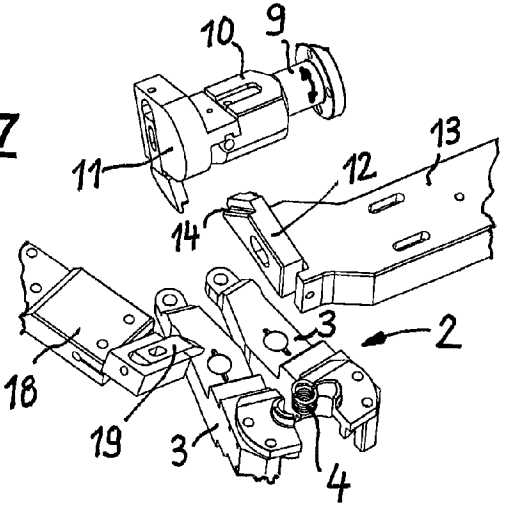
Figure 9:
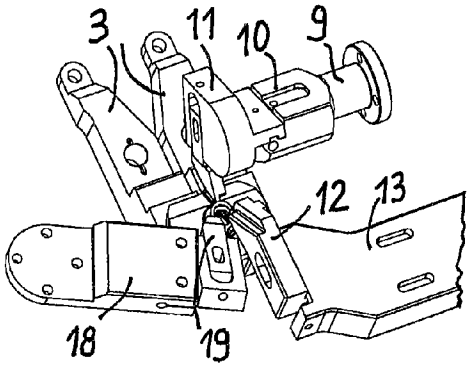
Figure 12:
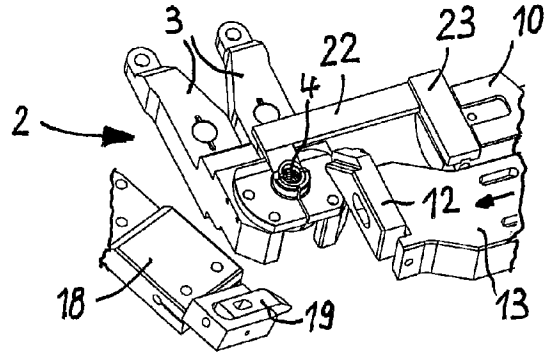
FIGS. 11, 12, 13, and 14 show the manufacture of a loop through "bending up" on a device, according to the invention, whereby the depicted individual procedural stages correspond with those in FIGS. 7 to 10, i.e., FIG. 11 corresponds with FIG. 7, FIG. 12 corresponds with FIG. 8, FIG. 13 corresponds with FIG. 9, and FIG. 14 corresponds with FIG. 10 (and also FIG. 6)

In the following, the sequence of the bending process as shown in FIGS. 7 to 10, shall be explained. As shown in FIG. 7, the spring 4 is gripped by the open gripper jaws 3 of the gripping unit 2 in a forward (i.e., in the direction of the assigned spring manufacturing machine) end position of the gripping unit 2 and, after the (not depicted) aligning of the spring 4 at the alignment unit 20, is feed to the loop unit (FIG. 8). FIG. 8 shows the attainment of the processing position, whereby it can be seen that the upper coil of the spring 4 is already somewhat pushed onto the bending block of the tool 11. Now, as shown in FIG. 9, the counter block 12 is moved askance via the spring body 7 (see also FIG. 3), while the bending block 19 above the spring 4 is simultaneously swiveled in (FIG. 9). Then the bending block 21 of the tool 11 is swiveled upward through counterclockwise rotation of the output shaft 9 and thereby bends the upper coil 6 of the spring 4 upward around the bending edge 14 of the bending block 12. The bending block 19, which abuts the end of the uppermost coil 6 of the spring 4, prevents a dodging of said coil 6 and allows a rebending of said coil for the precise alignment of the loop, if necessary.

Figure 13:
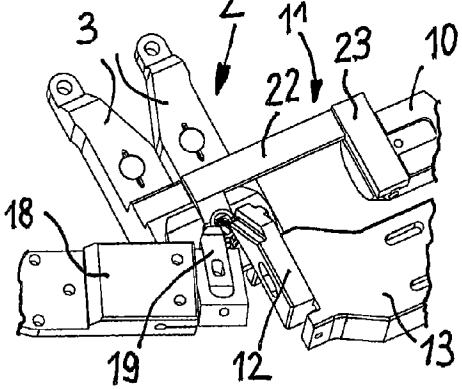

In the following, the "bending up" of the loop as shown in FIGS. 11 to 14 shall be briefly explained. Hereby, the rotational axis of the first slewing gear unit 8 is aligned in such a way that it lies parallel to the bending edge 14 around which the loop is to be bent. Once again, the spring 4 is gripped by the open gripper jaws 3 (FIG. 11), i.e., at a forward end position of the gripping unit 2. After the aligning in the alignment unit 20 (not shown), the spring 4 is fed to the loop unit, where it approaches the processing position and is pushed on this occasion over the forward end edge 24 of the positioning plate 22. Then the counter block 12 is moved askance via the spring body 7, while the bending block 19 is simultaneously swiveled in via the second slewing gear unit 15 (FIG. 13).

Figure 14:
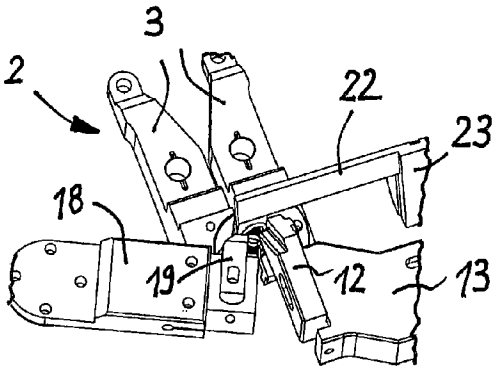
Figure 15:
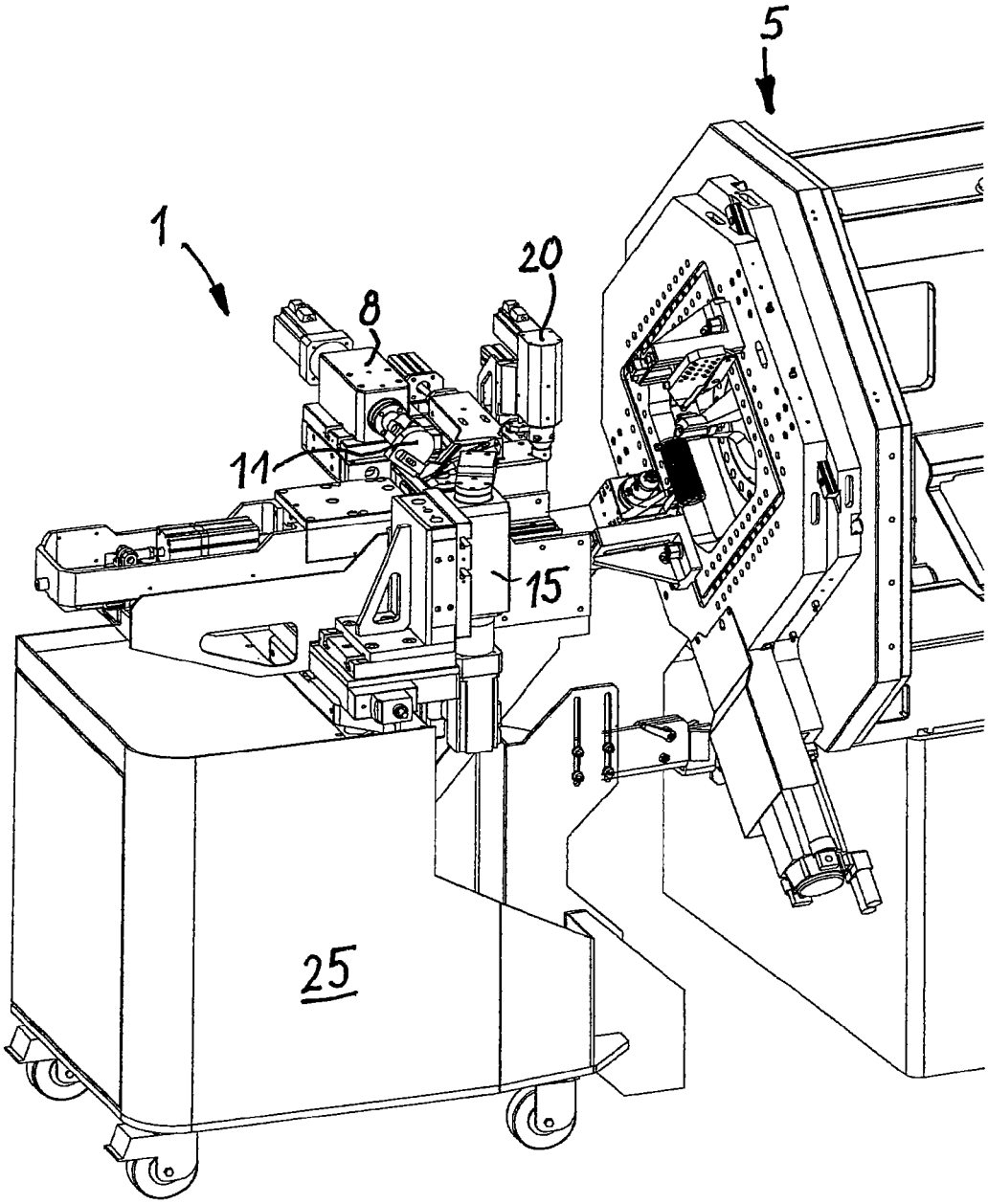
FIG. 15 shows a perspective view of a spring manufacturing machine, consisting of a leg spring machine with an upstream positioned loop manufacturing device, according to the invention.

FIG. 14 shows the condition whereby the positioning plate 22 and the bending axis 14 of the counter block 12 are swiveled and the coil section, which rests on the positioning plate 22, bent upward around the bending edge 14. Once again, the bending block 19, swiveled in from the second slewing gear unit 15, prevents an undesired dodging of the uppermost coil 6, as already described above.

The coil spring 4 can also be held in the gripping unit 2 in such a way that it not only—as shown in the drawings—protrudes over the gripper jaws 3 axially above by at least the section of the end turn 6 but similarly also on the opposite side of the gripper jaws 3 at the respective spring end. In this case, which is not depicted in the drawings, the gripping unit 2 must be designed swiveling around its longitudinal axis parallel to the direction of travel a, in order to allow for its bottom side to be swiveled upward and to also process the protruding spring end on that side, i.e., to equip with a loop.

Finally, FIG. 15 shows the assignment of a loop manufacturing device 1 at a spring winding machine 5. As can be seen therefrom, the device 1 is moved to the spring winding machine 5 on a movable stand 25 and fittingly coupled to said machine.

The invention claimed is:

1. A device for producing a loop at the end of a coil spring, the coil spring having a plurality of turns about a central axis, including an end turn, the device comprising:

a gripping unit with gripper jaws for retaining the coil spring in a processing position with a predetermined alignment of the central axis of the coil spring, the gripping unit being movable in one direction of travel to and from the processing position, and at least one section of the end turn of the coil spring protruding over the gripper jaws;

a first slewing gear unit having an output shaft drivable in opposing rotational directions and a coupling section detachably coupled with a tool for the forming of a loop on the coil spring, the tool configured to grip the at least one section of the end turn of the coil spring from underneath and bend the section with a rotary movement upwardly, the output shaft movable vertically as well as parallel to the direction of travel of the gripping unit and parallel to the central axis of the coil spring; and a counter block attached laterally to a slider configured to travel in a direction transverse to the direction of travel of the gripping unit, the counter block movable over the at least one section of the end turn of the coil spring protruding over the gripper jaws in the processing position of the gripping unit, the counter block having a protruding end exhibiting a bending edge serving as a bending form for bending the section of the end turn of the coil spring upwardly around the bending edge to produce the loop.

2. The device of claim 1, wherein the gripping unit is movable between the processing position and a gripping position where it grabs the coil spring at a spring manufacturing machine.

3. The device of claim 1, wherein the coil spring is held in the gripping unit with a vertical alignment of its central axis.

4. The device of claim 1, wherein at least one section of the end turn of the spring also protrudes on an opposite side of the gripper jaws and the gripping unit can be swiveled around a rotational axis vertical to the central axis of the coil spring.

5. The device of claim 1, further comprising a second slewing gear unit with a cantilever pivotable laterally to the central axis of the coil spring and a bending block, the second slewing gear unit adapted to be swiveled via a spring body in the processing position of the gripping unit to a stop at a free wire end of the end turn to prevent a dodging of the loop during the upward bending of the end turn of the coil spring.

6. The device of claim 1, further comprising a bending block provided at the output shaft of the first slewing gear unit, the bending block pivotable around the rotational axis of the output shaft as the tool, the bending block providing underneath gripping of a forward end of the section of the end turn of the coil spring for upward bending of said at least one section of the end turn.

7. The device of claim 1, further comprising a positioning plate at the output shaft of the first slewing gear unit mounted on a radial rotational tongue and aligned parallel to the rotational axis of the output shaft provided as the tool, the positioning plate during the approach of the gripping unit to the processing position being fed below the section of the end turn of the coil spring to bend the section up during the rotation of the first slewing gear unit.

8. The device of claim 5, wherein the second slewing gear unit is movable parallel to the central axis of the coil spring, vertically to the coil spring and vertically to the direction of travel of the gripping unit.

9. The device of claim 1, wherein the counter block is adjustable in the direction parallel to the central axis of the coil spring.

10. The device of claim 1, further comprising an alignment unit, the alignment unit adjustable vertically to the direction of travel of the gripping unit and to the central axis of the coil spring, the alignment unit allowing a position of the end turn of the coil spring, in accordance with a predetermined position of said coil spring, to be adjustable through a rotation of the coil spring in the gripper jaws of the gripping unit.

* * * * *